US007735296B2

(12) United States Patent
Momich

(10) Patent No.: US 7,735,296 B2
(45) Date of Patent: Jun. 15, 2010

(54) APPARATUS AND METHOD FOR A CARTON CARRIER

(75) Inventor: Zoran Momich, Schaumburg, IL (US)

(73) Assignee: Z Automation Company, Inc., Arlington Heights, IL (US)

( * ) Notice: Subject to any disclaimer, the term of this patent is extended or adjusted under 35 U.S.C. 154(b) by 0 days.

(21) Appl. No.: 11/901,407

(22) Filed: Sep. 17, 2007

(65) Prior Publication Data

US 2009/0071105 A1 Mar. 19, 2009

(51) Int. Cl.
*B65B 5/02* (2006.01)
*B65G 25/00* (2006.01)

(52) U.S. Cl. ..... 53/250; 53/257; 198/803.9

(58) Field of Classification Search ..... 53/249, 53/250, 251, 257, 381.1, 564; 493/319, 313, 493/314; 198/803.1, 803.9, 803.11, 803.13
See application file for complete search history.

(56) References Cited

U.S. PATENT DOCUMENTS 2,358,292 A * 9/1944 Malhiot ..... 198/803.11
3,122,071 A * 2/1964 Vogel ..... 493/319
3,325,977 A * 6/1967 Kirsten ..... 198/803.11
3,779,364 A * 12/1973 Kammann ..... 198/803.11
4,164,391 A * 8/1979 Howard et al. ..... 198/803.7
4,232,591 A * 11/1980 Karpinsky ..... 493/314
4,641,742 A * 2/1987 Igarashi et al. ..... 198/626.5
4,718,540 A * 1/1988 Greenwell ..... 198/803.11
4,891,928 A * 1/1990 James et al. ..... 493/319
5,072,573 A * 12/1991 Tisma ..... 53/257
5,238,101 A * 8/1993 Ota et al. ..... 198/803.11
5,360,099 A * 11/1994 Culpepper et al. ..... 198/803.11
5,613,828 A * 3/1997 Haddow et al. ..... 53/564
5,697,490 A * 12/1997 Raque ..... 198/803.9

* cited by examiner

*Primary Examiner*—Louis K Huynh
(74) *Attorney, Agent, or Firm*—Pauley Petersen & Erickson

(57) ABSTRACT

This invention relates to a product cartoning system having dynamic carton carriers that may restrain or not restrain the package during different steps of the cartoning process. Certain steps such as vibrating may benefit from open carton carriers while other steps such as closing a side of the carton may benefit from closed carton carriers. This invention also relates to a product cartoning system having adjustable carton carriers driven by more than one carton chain to allow varying a width between two of the carton carrier sidewalls to accommodate different size or shape cartons. This invention also relates to methods of use for the product cartoning systems of this invention.

10 Claims, 4 Drawing Sheets

APPARATUS AND METHOD FOR A CARTON CARRIER

BACKGROUND OF THE INVENTION

1. Field of the Invention

This invention relates to a product cartoning system having dynamic carton carriers and/or a variable width between two of the carton carrier sidewalls to accommodate different sized cartons.

2. Description of Related Art

Cartoners are used in varied applications requiring the placement of a product or products, such as food, pharmaceuticals, beverages and other items, into cartons or boxes. Cartoners traditionally require a carton chain to transport empty cartons for filling.

Traditional cartoners often include buckets having fixed sidewalls for transporting cartons. However during certain cartoning steps fixed sidewalls may not hold the carton as sufficiently as may be desired and during cartoning other steps may hold the carton too much. During vibrating or conditioning of product such as, for example, potato chips, it may be advantageous to not restrain the package. During other cartoning steps, such as, for example, closing a lid, it may be desired to maintain positive control of the packaging.

Conventional cartoners with fixed buckets are sized to accommodate a specific carton size and/or shape. These fixed buckets may not be adjusted to accommodate different sizes and shapes of cartons as easily as may be desired. For example, preparing a candy bar for sale in a grocery store may involve 6 to 8 pieces of the candy bar, while packages for a wholesale club can be multiples of that such as 24 to 48 pieces. Conventional buckets require either an expensive separate cartoning line for different sizes or significant downtime to retool between sizes and/or products.

SUMMARY OF THE INVENTION

Accordingly, it is one object of this invention to provide a product cartoning system having dynamic carton carriers that can facilitate the cartoning process by holding and releasing the carton during the cartoning process. It is another object of this invention to provide a product cartoning system having variable width carton carriers to accommodate different carton sizes and/or shapes. All carton carrier widths on the product cartoning system may be varied by a single adjustment.

These and other objects of this invention are addressed by a product cartoning system that may include one or more dynamic carton carriers on a continuous carton chain which is movable on a frame. The carton carrier may include a first sidewall and a second sidewall disposed on the carton chain. Desirably, the first sidewall may be movable relative to the second sidewall by a sidewall cam and a cam follower to dynamically adjust at least one of the first sidewall and the second sidewall with respect to a position on the carton chain and a position along the frame. This configuration may be referred to as having dynamic carton carriers which may facilitate certain steps of cartoning by being open or closed, such as, for example, closed while shutting the carton and open while conditioning the product.

The product cartoning system may include the first sidewall leading relative to the second sidewall which follows. The product cartoning system may further include at least a third dynamic sidewall, a vibratory mechanism along at least a portion of the frame, or a carton placement and erection device.

The carton carriers may be disposed substantially vertically or substantially horizontally on the track or circuit of the product cartoning system. Desirably, carton carriers may mount substantially parallel to carton chain.

According to another preferred embodiment of this invention, a product cartoning system may include a first continuous carton chain movable on a frame and a second continuous carton chain movable on the frame and movable relative to the first carton chain. The system may further include a plurality of carton carriers with a first sidewall disposed on the first carton chain and a second sidewall disposed on the second carton chain. A width between the first sidewall and the second sidewall may be variable by altering a relative position of the first carton chain to the second carton chain. An adjustment of the relative position of the first carton chain to the second carton chain may be made by a servo interconnect. This configuration may be referred to as having variable width carton carriers. Variable width may allow use of different sized cartons on the same line. Advantageously, by changing only one setting, the widths of all the carton carriers on the product cartoning system are changed.

According to another preferred embodiment of this invention, a product cartoning system may include both the features and functions of dynamic carton carriers and variable width carton carriers.

This invention also includes methods of using the product cartoning system. The method may include placing a carton on a carton carrier with a first sidewall and a second sidewall, wherein the carton carrier is disposed on at least one carton chain movable on a frame. The method may also include compressing the carton dynamically between the first sidewall and the second sidewall relative to varying positions along the frame, inserting at least one product into the carton, and releasing the carton from the carton carrier. Additionally, the method may include the step of shutting at least one side of the carton, the step of conditioning the product with at least one vibratory mechanism, or the step of changing a relative position between a first carton chain and a second carton chain to vary a width between the first sidewall and the second sidewall for a different size carton.

The method may further include changing a speed of the first carton chain and the second carton chain along the frame based on the different carton size and changes in the product.

According to a preferred embodiment of this invention, the method may include placing and/or erecting a carton on a carton carrier with a first sidewall and a second sidewall, wherein the carton carrier is dynamically disposed on at least one carton chain movable on a frame. The method may further include compressing the carton dynamically between the first sidewall and the second sidewall while shutting at least one side of the carton, releasing the carton by spreading at least one of the first sidewall and the second sidewall while inserting at least one product into the carton, releasing the carton while conditioning the product, compressing the carton dynamically while shutting at least one other side of the carton, and releasing the carton while discharging the carton. Alternately, during the step of shutting at least one side of the carton, the first sidewall and the second sidewall may remain in a released position.

BRIEF DESCRIPTION OF THE DRAWINGS

These and other objects and features of this invention will be better understood from the following descriptions taken in conjunction with the drawings wherein.

DETAILED DESCRIPTION OF THE PREFERRED EMBODIMENTS

Figure 1:
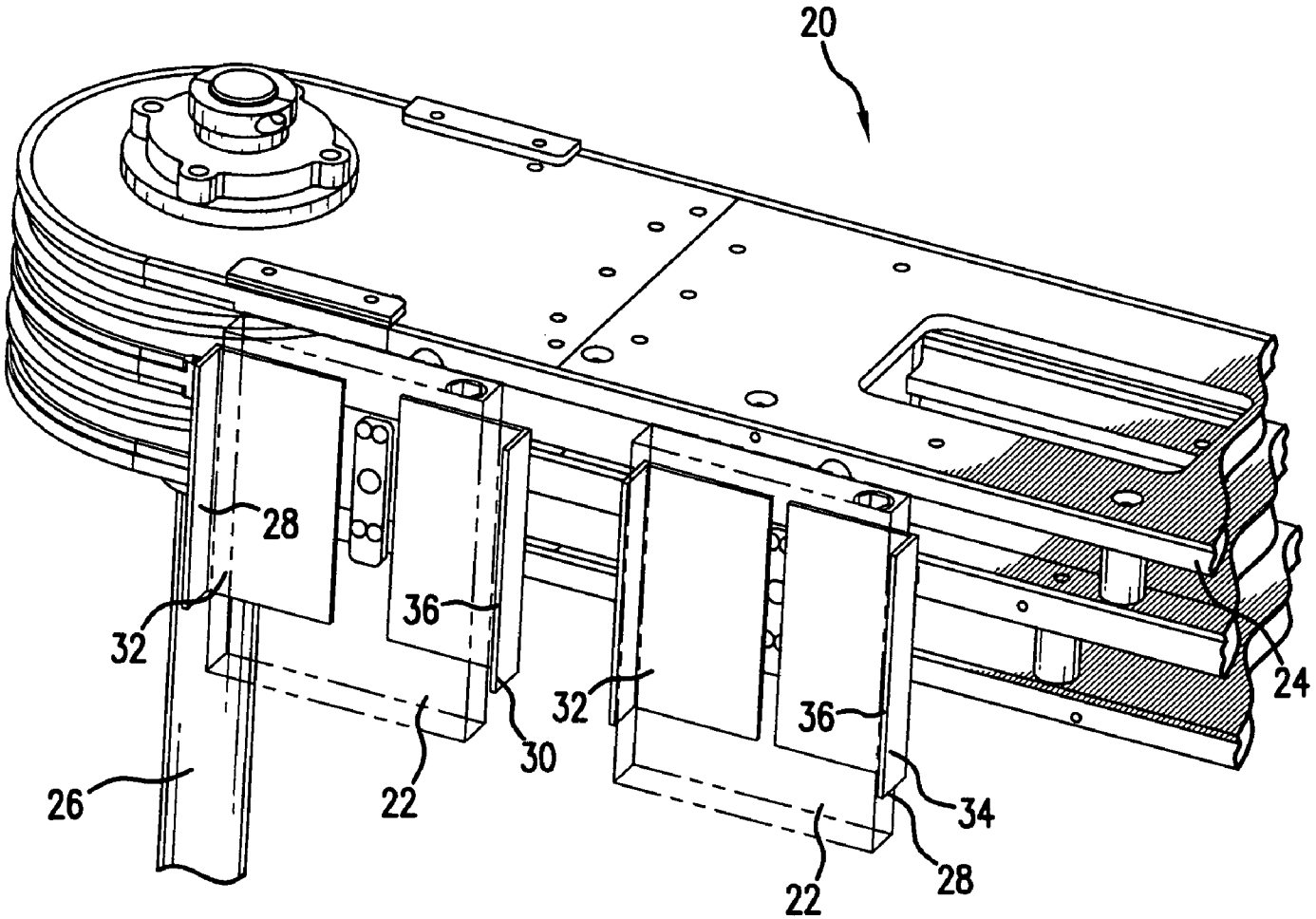
FIG. 1 is a perspective view of a product cartoning system, according to one preferred embodiment of this invention.

FIG. 1 shows product cartoning system 20, according to one preferred embodiment of this invention, that may be used for loading or filling cartons 22. Product cartoning system 20 may include carton chain 24 mounted on frame 26. The carton chain 24 may have one or more carton carriers 28 disposed or attached to carton chain 24. Typically, carton carrier 28 or buckets may include sidewalls which include first sidewall 32 and second sidewall 36.

Desirably, product cartoning system 20 may include a cam having a varying profile along a path of carton chain 24 and frame 26. A cam follower may then interact with the cam to dynamically adjust one or both of first sidewall 32 and second sidewall 36 with respect to a position on carton chain 24 and/or a location on frame 26. The dynamic adjustment may include open position 30, closed position 34 and any position in between. Dynamic adjustment may be useful in providing positive control (closed position) of carton 22 during movement along carton chain 24 and during cartoning steps or processes, such as, for example, during closing or shutting of a side of carton 22. Alternately, dynamic adjustment may be useful in providing clearance or float (open position) around carton 22, such as, for example, during filling, conditioning, and discharge.

Product may include one or more goods or items contained within or by carton 22, such as, for example, food, beverages, pharmaceuticals, consumer goods, bulk goods, packages, papers and any suitable other object. Typically, product may include bottles, trays, bags, individual pieces, composite or assembled pieces and any other suitable thing that may benefit from carton 22.

Carton 22 may broadly include boxes, containers, bottles, jars, carriers, packaging, bags, or any other suitable form to permanently or temporarily have at least a portion of product substantially housed within. Carton 22 may have any shape or size to accommodate the size and/or the quantity of product. Desirably, carton 22 may be stackable to allow for shipment and/or retail store stocking. Carton 22 may desirably have a width that is at least about twice as long as a thickness. Typical materials for carton 22 may include paper, cardboard, plastic, film, metal, wood and any other suitable substance or combination for making carton 22.

Frame 26 may include any suitable supporting structure for holding or maintaining product cartoning system 20. Desirably, frame 26 provides rigidity and may be substantially engineered to withstand transient and operational forces from use of product cartoning system 20. According to a preferred embodiment of this invention, frame 26 includes a lattice or truss arrangement of steel members along a full circuit length of carton chain 24.

Carton chain 24 desirably is continuous in design as may be adapted to operation in a repeating manner, such as, for example, in a conveyor-like arrangement. Carton chain 24 may include broadly belts, chains, linkages, ropes, filaments and any other suitable mechanically movable mechanisms. Carton chain 24 typically may be mounted on at least of a portion of frame 26 and desirably is movable with respect to frame. Movable, indexable, or slidable may allow advancing and/or reversing carton chain 24 in varying speeds or velocities at continuous or discrete intervals or periods, to accommodate the cartoning process. Carton chain may be guided or assisted by bearings, motors, drivers, idlers, sleeves, pulleys, cogs, linkages, rails, baffles or any other suitable mechanical structure to allow movement.

Generally, carton carrier 28 may have any suitable size and/or shape needed to accommodate cartoning one or more different products. Desirably, carton carrier 28 includes at least one sidewall to assist in locating or holding carton 22. Sidewalls generally may include structures such as lips, flanges, or any other suitable shape to assist or facilitate cartoning product 20. According to a preferred embodiment of this invention, carton carrier 28 includes first sidewall 32 and second sidewall 36, such as, for example, when processing a substantially rectangular carton 22 with an open top and an open bottom. Alternately, a third sidewall may be included to further support carton 22 during cartoning steps.

Sidewalls may be static or dynamic. Static sidewalls may include fixed or substantially rigid structures that do not appreciably move with respect to carton chain 24 along a position on frame 26. Static sidewalls may include those that move along the product cartoning system 20 on carton chain 24 but do not actively squeeze or compress carton 22.

In contrast, dynamic sidewalls may include moving or substantially active structures that do appreciably move with respect to carton chain 24 along a position on frame 26. Dynamic sidewalls may include those that move along the product cartoning system 20 on carton chain 24 and do actively squeeze or compress carton 22. Therefore, first sidewall 32 may move relative to second sidewall 34. During some cartoning processes along the circuit, it may be desirable to restrict carton 22, such as, for example, during movement between steps or locations, and closing a side of carton 22. During other cartoning processes along the circuit, it may be desirable to not restrict carton 22, such as, for example, during filling, vibratory conditioning or discharge of carton 22.

Typical sidewall configurations may include any combination of static and dynamic sidewalls needed to achieve suitable cartoning processes, such as, for example, one static sidewall and one dynamic sidewall, or two dynamic sidewalls. Dynamic sidewalls desirably vary or change a location of the dynamic sidewall with respect to a position on product chain 24, such as, for example from open position 30 to closed position 34. Even more desirably the change in the dynamic sidewall can occur at different locations along frame 26, such as, for example, at a placing location, a filling location, a conditioning location and a discharging location.

Generally, dynamic adjustment and/or linear reciprocation can occur or happen by a sidewall cam and cam follower arrangement which at various locations along the frame may include different profiles or shapes to cause adjustment. The cam may include a track, a groove or other suitable devices along the circuit of product cartoning system 20. The cam follower may include one or more wheels, nubs or other suitable tracking mechanisms actuated by the cam.

Those skilled in the art and guided by the teachings herein will readily appreciate that other mechanical, pneumatic, hydraulic, electrical and/or electromechanical apparatus may be employed to achieve the desired dynamic adjustment. According to a preferred embodiment of this invention, sidewall cam and cam follower dynamically adjust first sidewall 32 and/or second sidewall 36 with respect to a position on carton chain 24 and a position along frame 26.

Exemplary mechanisms using rack and pinion configurations with linear kinematics for dynamic adjustment of a carrier may be found in Momich, U.S. Pat. No. 6,912,826, the entire the teachings of which are incorporated into this specification by reference.

Figure 2:
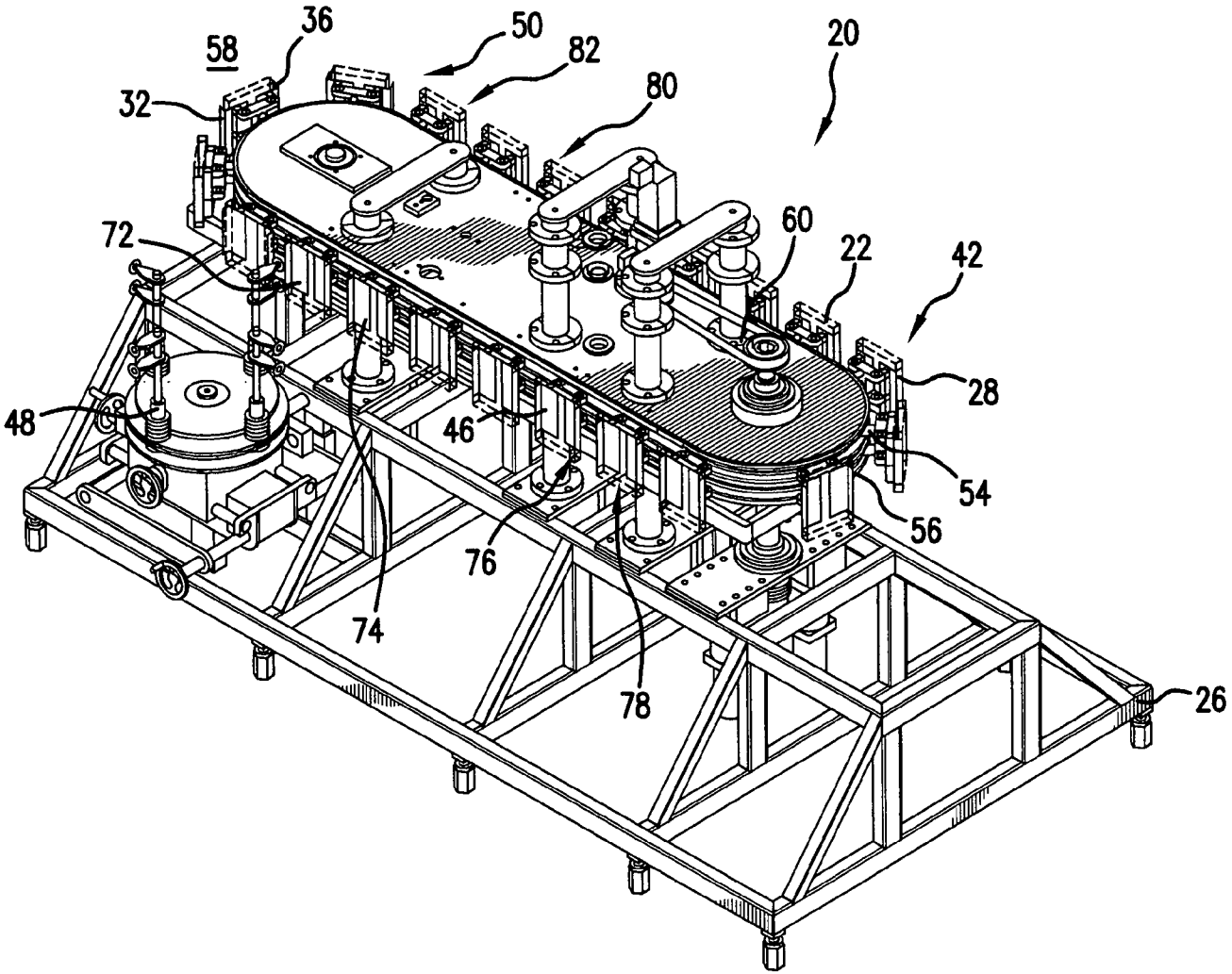
FIG. 2 is a perspective view of a product cartoning system according, according to one preferred embodiment of this invention.

As shown in FIG. 2 and according to a preferred embodiment of this invention, product cartoning system 20 may include plurality 42 or several carton carriers 28 located or disposed on or along carton chain 24. There is no limitation as to the number of carton carriers 28 that may be employed. Product cartoning systems 20 may include 10, 20, 50, 100 or any other suitable number of carton carriers 28 to facilitate desired cartoning processes. Dynamic carton carriers 28 may include shuttles, buckets or holders having at least one dynamic sidewall.

Typically, but not necessarily, first sidewall 32 is in a leading position relative to second sidewall 36 when product cartoning system 20 is operating in a normal machine processing direction.

Depending upon the product being cartoned and the packaging requirements, additional conditioning may be desired. Suitable conditioning steps may include squeezing, settling, agglomerating, compacting, unagglomerating, shaking, aerating, fluffing, tensioning or any other suitable action to facilitate cartoning processes and/or improve product quality. As shown in FIG. 2 and according to a preferred embodiment of this invention, at least one vibratory mechanism 46 is included along the circuit.

Vibratory mechanism 46 may include pneumatic, electromagnetic and any other suitable device for imparting a desired frequency and amplitude into product and/or carton 22.

As shown in FIG. 2, product cartoning system 20 may include carton placement and erection device 48. Desirably, carton placement and erection device 48 may pick up flattened carton 20 and place or locate carton 20 in and/or on carton carrier 28 while also forming or erecting carton 20 in preparation of receiving product. Additional steps of closing one or more sides of carton 22 may also be included by carton placement and erection device 48 or may be done during subsequent processing on product cartoning system 20.

Figure 3:
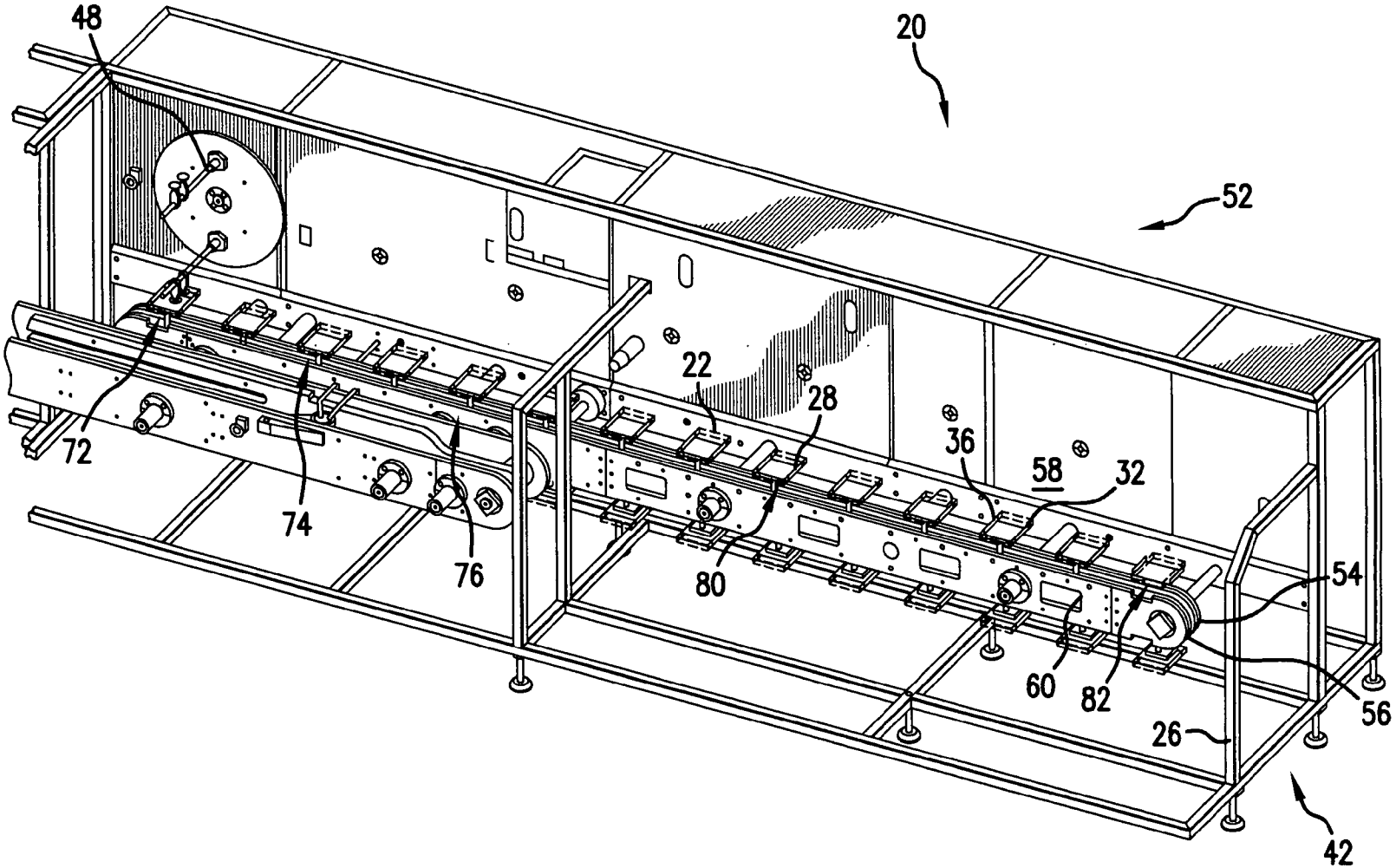
FIG. 3 is a perspective view of a product cartoning system, according to one preferred embodiment of this invention.

Possible positions for carton carriers 28 may include substantially vertical position 50, as shown in FIG. 2, substantially horizontal position 52, as shown in FIG. 3, and any suitable position in between. Desirably, flowable products, such as, for example, individually wrapped bubble gum pieces may be cartoned in vertical position 50 aided by the assistance of gravity. Alternately, relatively slidable products, such as, for example, a frozen pizza may be cartoned by in horizontal position 52 to minimize loss of toppings. Product cartoning systems 20 with both horizontal position 52 and vertical position 50 may be possible with a bendable or twistable belt. A combination position may allow increased utility for loading different materials into the same carton 22, such as for example horizontally loading a fragile vase (slidable) and then vertically loading packing peanuts (flowable) around the vase.

According to a preferred embodiment of this invention and as shown in FIGS. 2 and 3, product cartoning system 20 may include first carton chain 54 and second carton chain 56. Generally, first chain 54 and second carton chain 56 may be of similar design and capability as described above with respect to carton chain 24.

Desirably, first carton chain 54 and second carton chain 56 are synchronized with respect to each other around the circuit or path. Synchronized typically may include keeping a specific position on first carton chain 54 at a constant distance from a specific position on second carton chain 56.

Product cartoning system 20 may include a mechanism or device for varying or changing the relative position of first carton chain 54 with respect to second product chain 56. Pulleys, belts, transmissions and other suitable devices may be used to change the relative position of first carton chain 54 and/or second carton chain 56. The mechanism for varying the relative position of carton chains 24 desirably adjusts all carton carriers 28 at the same time with a single adjustment or action.

According to a preferred embodiment of this invention, changing relative position between first carton chain 54 and second carton chain 56 is made by servo interconnect 60. Servo interconnect 60 may allow for precise and instantaneous size changes.

Carton carriers 28 may generally be disposed or connected to both first carton chain 54 and second carton chain 56. Desirably, first sidewall 32 may be connected to first carton chain 54 and second sidewall 36 may be connected to second carton chain 56. Other combinations of additional carton chains 24 having one or more sidewalls attached may be possible. Maintaining synchronization between first carton chain 54 and second carton chain 56 may ensure smooth reliable operation of product cartoning system 20.

Generally, all of the characteristics of carton carrier 28 and sidewalls discussed above apply to product cartoning systems 20 with multiple carton chains 24, particularly static and dynamic adjustment features including cam and cam follower arrangements. One or more cams may have one or more cam followers for one or more carton chains 24. It may be possible to independently actuate multiple sidewalls on the same carton carrier 28 at the same time by the use of multiple carton chains 24, cams, and cam followers.

First sidewall 32 disposed on first carton chain 54 and second sidewall 36 disposed on second carton chain 56 may form width 58 between the sidewalls. Since first sidewall 32 and second sidewall 36 may be on different carton chains 28, width 58 may be varied by changing a relative position between first carton chain 54 and second carton chain 56, such as, for example by indexing servo interconnect 60. Changing or varying width 58 may permit or facilitate operating product cartoning system 20 on different size cartons 20 without duplicating equipment or requiring costly maintenance time for reconfiguration.

One exemplary use may include boxing 14 inch large pizzas and then boxing 8 inch medium pizzas on the same line after narrowing width 58. The use of two or more carton chains 24 may allow varying width 58 on every carton carrier 28 in plurality of carton carriers 42. This single step adjustment may save time and resources from having to manually adjust each carton carrier 28 to accommodate a different carton 22 size.

Control mechanisms for product cartoning system 20 may include linkages, relays, interlocks, programmable logic controllers (PLCs), distributed control networks, hybrid or fieldbus control systems and any other suitable interfacing and/or operating devices. Desirably, product cartoning system may be part of a larger automated packaging process which may include, for example, feeders, conveyors, aligners, turners, collators, conditioners, sorters, palletizers and any other suitable equipment to compliment the form and/or the function of product cartoning system 20.

In summary, product cartoning system 20 of this invention may broadly include embodiments with dynamic carton carriers 28 and one carton chain 24, multiple carton chains 54, 56 and a variable width 58 carriers 28 for different size cartons 22, devices with both dynamic carriers 28 and variable width 58 carriers 28.

Figure 4:
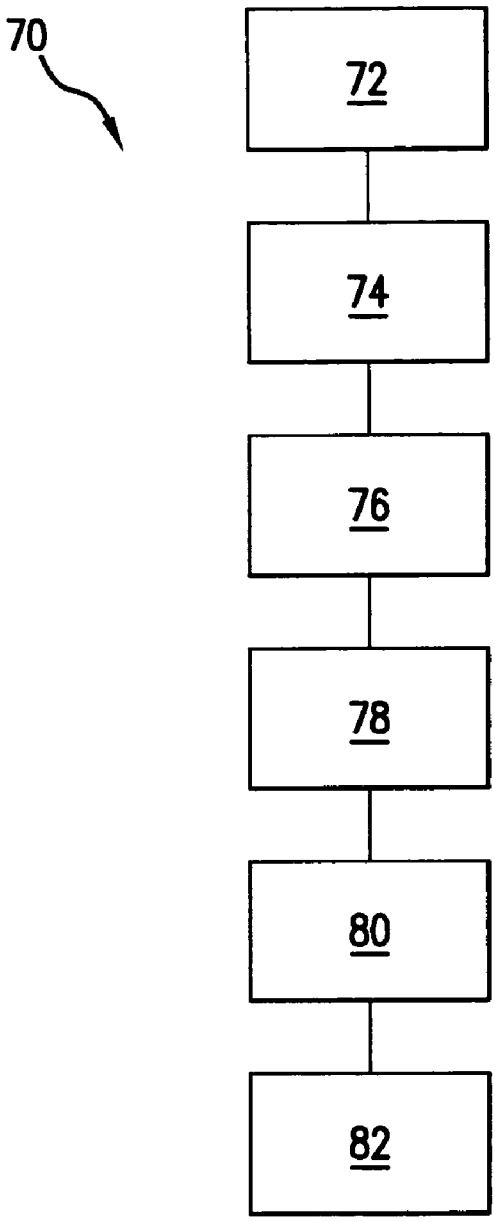
FIG. 4 is a schematic diagram of a method for cartoning product according to one preferred embodiment of this invention.

As shown in FIG. 4, this invention also includes method 70 for using product cartoning system 20. No limitation of order and/or frequency of steps should be taken or implied by this written description and the figures. Those skilled in the art and guided by the teachings herein will readily appreciate the adaptability and versatility of this invention for various cartoning or packaging operations.

As shown in FIGS. 2-4, method 70 may include placing 72, shutting 74, inserting 76, conditioning 78, shutting 80, and discharging 82. Placing 72 carton 22 on product cartoning system 20 may include setting, locating and any other suitable action to facilitate product loading into carton 22. Desirably, placing 72 may also include the erecting or opening action to prepare carton 22 for receiving product. Generally, dynamic carton carrier 28 may be in relatively open position 30 during placing 72 but may move to closed position 36 to facilitate erecting.

Desirably, dynamic carton carrier 28 may be in closed position 34 or compressed position when not explicitly required to be in open position 30, spread, released or uncompressed to assist or aid a cartoning step. Varying degrees or forces of compression are possible based on the configuration of sidewalls, cam and cam follower, such as, for examples holding carton 22 during movement may require relatively light pressure and breaking an agglomerated product may require a higher force.

Shutting 74 may include closing, folding, sealing, forming and any other suitable action to further shape carton 22 for receiving product. Desirably, shutting may include carton carrier 28 being in relatively closed position 34 or compressed without deforming carton 22. Alternately, shutting 74 may occur in open position 30. This step may not be required for all carton 22 designs.

Inserting 76 may include placing, driving, and any other suitable action to allow carton 22 to receive product. Desirably, inserting 76 may include carton carrier 28 being in relatively open position 30 or uncompressed.

Alternately and as shown in FIG. 2, conditioning by vibratory mechanism 46 may be included in method 70. Conditioning product as discussed above may include any suitable action to improve product and/or packaging. Desirably, conditioning may include carton carrier 28 being in a relatively open position 30 or uncompressed. If in closed position 34, then vibratory energy may be unnecessarily dampened. Other condition steps may benefit from open position 30.

Shutting 80 may typically fully enclose product in carton 22. Characteristics applicable to shutting 80 generally coincide with those discussed above with respect to shutting 74.

Releasing 82 may include freeing, uncoupling, discharging and any other suitable action to allow carton 22 to finish processing. Desirably, releasing 82 may include carton carrier 28 being in relatively open position 30 or uncompressed.

As shown in FIGS. 2-3, steps of method 70 may occur at certain points or locations along product cartoning system 20. Various additional configurations may be made by adapting a length of the circuit to accommodate additional steps.

When changing product type, size and/or quantity as well as different cartons 22, it may be advantageous to change width 58 and/or change a speed of product cartoning system 20.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

What is claimed is:

1. A product cartoning system comprising:

a first continuous carton chain movable on a frame;

a second continuous carton chain movable on the frame and movable relative to the first carton chain;

a sidewall cam positioned along the frame; and a plurality of carton carriers, each carton carrier of the carton carriers including a cam follower, a first sidewall disposed on the first carton chain and a second sidewall disposed on the second carton chain, wherein a width between the first sidewall and the second sidewall is variable as the plurality of carton carriers move along the frame by altering a relative position of the first carton chain to the second carton chain, wherein the width between the first sidewall and the second sidewall changes following engagement of the cam follower with the sidewall cam at a position along the frame.

2. The product cartoning system of claim 1, wherein an adjustment of the relative position of the first carton chain to the second carton chain is made by a servo interconnect.

3. The product cartoning system of claim 1, wherein the carton carriers are disposed in a position selected from the group consisting of substantially vertical and substantially horizontal.

4. The product cartoning system of claim 1, wherein the first sidewall is leading relative to the second sidewall which follows.

5. The product cartoning system of claim 1, further comprising at least a third sidewall positioned on a third continuous carton chain on at least a portion of the frame.

6. The product cartoning system of claim 1, further comprising a carton placement and erection device.

7. A product cartoning system comprising:

a first continuous carton chain movable on a frame;

a second continuous carton chain movable on the frame and movable relative to the first carton chain during engagement with a carton;

a sidewall cam positioned along the frame; and a plurality of carton carriers, each carton carrier of the carton carriers including a cam follower, a first sidewall disposed on the first carton chain and a second sidewall disposed on the second carton chain, wherein a width between the first sidewall and the second sidewall is variable as the plurality of carton carriers move along the frame by altering a relative position of the first carton chain to the second carton chain, wherein the width between the first sidewall and the second sidewall adjusts several times following engagement of the cam follower with the sidewall cam at a position along the frame.

8. The product cartoning system of claim 7, wherein the first sidewall is leading relative to the second sidewall which follows.

9. The product cartoning system of claim 7, further comprising at least a third sidewall positioned on a third continuous carton chain along at least a portion of the frame.

10. The product cartoning system of claim 7, further comprising a carton placement and erection device.

* * * * *